US005590810A

United States Patent [19]

Wehbi

[11] Patent Number: 5,590,810

[45] Date of Patent: Jan. 7, 1997

[54] ORDER OF PARTICIPATION CONTROL DEVICE

[76] Inventor: Ali D. Wehbi, 343 E. College St., Murfreesboro, Tenn. 37130

[21] Appl. No.: 545,283

[22] Filed: Oct. 19, 1995

[51] Int. Cl.[6] ..... A63D 15/00

[52] U.S. Cl. ..... 221/82; 221/89; 473/1; 473/4

[58] Field of Search ..... 273/149 R; 473/1, 473/27, 4; 221/82, 83, 86, 89, 91

[56] References Cited

U.S. PATENT DOCUMENTS

| | | | |
|---|---|---|---|
| 156,415 | 11/1874 | Elmsley | 473/27 |
| 298,402 | 5/1884 | Pope . | |
| 346,880 | 8/1886 | Wittman | 473/27 |
| 934,907 | 9/1909 | Fritsche | 221/82 |
| 1,125,640 | 1/1915 | Bernard | 473/27 |
| 1,151,711 | 8/1915 | Pfleeger | 221/82 |
| 1,792,166 | 2/1931 | Horstmann | 473/1 |
| 1,967,217 | 7/1934 | Amsden | 473/1 |
| 2,792,147 | 5/1957 | Stewart | 221/82 |
| 3,232,622 | 2/1966 | Lambert | 273/149 R |
| 3,861,678 | 1/1975 | Fansler | 473/4 |
| 4,016,937 | 4/1977 | Abraham | 473/4 |
| 4,840,376 | 6/1989 | Garrett | 473/1 |
| 5,071,121 | 12/1991 | Garrett | 473/1 |
| 5,505,665 | 4/1996 | Bumstead | 473/1 |

*Primary Examiner*—H. Grant Skaggs
*Attorney, Agent, or Firm*—Waddey & Patterson; I. C. Waddey, Jr.

[57] ABSTRACT

A device designed to attach to the side of a pool table. The device includes a plate which screws onto the side of the pool table and has a hole cut out of the center of it. One or more depressible stop members are mounted about the perimeter of the hole in the middle of the plate.

A ticket dispensing wheel is rotatably mounted within the hole. The ticket dispensing wheel has a center aperture, or hub, and the wheel is enclosed by a cover. The cover includes a disc with a sleeve extending perpendicularly from the center thereof. The sleeve is capped on the end of the sleeve opposite the disc so that the cover can be mounted on the pool table. The sleeve fits within the center aperture of the ticket dispensing wheel and the wheel has an opening in the upper portion of it communicating with the axial cavity of the sleeve.

The ticket dispensing wheel is generally pie-shaped and has a thickness proximating the thickness of the axial length of the sleeve. The center aperture of the ticket dispensing wheel mates with and fits over the sleeve and allows the wheel to rotate about the sleeve. Extending radially from the center opening in the wheel are vanes that divide the interior chamber of the wheel into multiple compartments. Slots are provided in the outer perimeter of the wheel, one slot communicating with each compartment of the chamber as created by the radially extending vanes. The compartments of the chamber are each numbered and there are an equal number of cards having corresponding numbers on them. The cards are placed through the appropriately numbered slots into the compartments and as the wheel is turned, the next numbered card will drop through the opening in the sleeve and into the axial cavity of the sleeve to be picked up by a challenger. The challenger will hold that card and will know his order of placement as a result of the number of the card. The next challenger can rotate the wheel through one notching sequence and the next numbered card will drop through the opening into the axial cavity of the sleeve and the challenger can pick up that card and know his order in the challenge ladder.

6 Claims, 3 Drawing Sheets

ORDER OF PARTICIPATION CONTROL DEVICE

BACKGROUND OF THE INVENTION

The present invention relates generally to an order of participation control device and more particularly to a system and structure which will eliminate confusion in the order of activity or participation as among a number of challengers in a "loser sits" game.

The present invention would be applicable to any situation where the order of activity or participation is voluntarily undertaken by the participants such as, specifically, pocket billiard or pool games taking place in public establishments where a bystander challenges the winner of an ongoing match between two participants. If there is more than one challenger, the order of participation is generally controlled by the concept of "first come-first served", but there are occasions when challengers forget (or intentionally misrepresent) the order in which challenges were issued and their "spot in line" to participate. These situations can be difficult, ranging from uncomfortable to violent, depending upon the circumstances. Thus, there is a need for a method of controlling order of participation in such events and eliminating the opportunity for confusion and misunderstandings about the order of participation of challengers.

While the present invention will be described in conjunction with pool games, it will be understood by those skilled in the art that the system and device would be equally applicable to other similar situations. For example, in playground basketball, there are often several groups waiting to play, and disputes can arise over the order of appearance of players or the order of appearance of teams to challenge the winner of an ongoing game for the next opportunity to play. The device would also be applicable for controlling the order of service in retail establishments, for example, fast food ice cream shops, the order of service for wrapping of packages in department stores at Christmas and the like.

Traditionally, in public establishments where billiards, pocket billiards (pool) and similar table games are available for play either for a fee or as an amenity of the establishment, the custom has developed throughout this country of spectators challenging the winner of an ongoing game with the loser sitting out the match between the winner and the challenger. When there are only three participants, this situation is easily controlled because the only bystander of interest is the challenger and there is no confusion as to who is next to play. However, when there are several challengers, the order of play can become confused and a matter of dispute among the challengers. These disputes can be friendly and generally easily resolved, but occasionally, they become heated and even violent. Because pool tables are provided in many establishments that serve alcohol, the occasion for such disputes can increase when participants have had too much to drink.

Over the years, one method of controlling the challenger order of participation has been by the challengers placing a quarter on the rail of the table. Historically, placing quarter on the rail of the table was to pay for the next game so that the challenger paid for the play of the next game and if the winner continued to win, he could play free. The price of pool has increased over the years and most establishments that have pool tables have coin operated tables which may require two, three or four quarters to release the pool balls so that a game can be played. In these circumstances, generally the challenger places on the rail a number of quarters necessary to pay for the next game and establishes himself as the "next up" challenger. If a second challenger appears before the ongoing game is finished, he can place quarters representing the price of the game on the rail indicating that he also wants to challenge. This process continued and often times there may exist as many as three, four or five challengers waiting to play. The confusion arises because quarters are fungible and there is no precise method of knowing which quarter belongs to which challenger and the order in which quarters were placed on the table.

This problem has been recognized in the past and at least two inventors have attempted to resolve the problem by devices and systems for which patents have issued. Specifically, in 1975, U.S. Pat. No. 3,861,678 was issued to Fansler and directed specifically at this problem. The Fansler device was a strip of material with several numbers on it and each challenger would place his quarter on the next highest number in order to identify his position in the challenger group. If a person wanted to challenge and there were two pending challenges with quarters on numbers 1 and 2, he would place his quarter on spot number 3 and would then be obligated to remember that he was number 3 in the order of challenge. Others might follow and place their quarters behind the number 3 challenger. However, this system still required persons to remember the number they had placed their quarter on and to be honest about that recollection. When people have played several games during the course of a night, they may get confused over the number on which they had placed their quarter for this particular game as compared to a previous game and a will dispute arise over the order of challenge. Others might intentionally misrepresent the number on which they place their quarter and create such a dispute. Thus, the Fansler device is lacking in control of the very problem which it attempts to address.

In 1977, U.S. Pat. No. 4,016,937 was issued to Abraham on a device directed to this same problem. However, the Abraham device required the same memory and honesty by the challengers and was fraught with the same problems as the Fansler device. Understanding this background, Applicant has realized that there is a need for a device that would control the next up order of challenge in pool games and other similar situations which would prevent confusion as to the identity of the next challenger and the order of participation by the various parties desiring to play. Such a device is presently lacking in the prior art.

SUMMARY OF THE INVENTION

Applicant's device is designed to attach to the side of a pool table. The device includes a plate which screws onto the side of the pool table and has a hole cut out of the center of it. One or more depressible stop members are mounted about the perimeter of the hole in the middle of the plate.

A ticket dispensing wheel is rotatably mounted within the hole. The ticket dispensing wheel has a center aperture, or hub, and the wheel is enclosed by a cover. The cover includes a disc with a sleeve extending perpendicularly from the center thereof. The sleeve is capped on the end of the sleeve opposite the disc so that the cover can be mounted on the pool table. The sleeve fits within the center aperture of the ticket dispensing wheel and the wheel has an opening in the upper portion of it communicating with the axial cavity of the sleeve.

The ticket dispensing wheel is generally pie-shaped and has a thickness proximating the thickness of the axial length of the sleeve. The center aperture of the ticket dispensing wheel mates with and fits over the sleeve and allows the wheel to rotate about the sleeve. Extending radially from the center opening in the wheel are vanes that divide the interior chamber of the wheel into multiple compartments. Slots are provided in the outer perimeter of the wheel, one slot communicating with each compartment of the chamber as created by the radially extending vanes. Also, on the outer perimeter of the wheel are ratchet bosses having a ramp surface and an abutment surface and placed in a position to engage the depressible stop members spaced about the hole on the plate. Thus, the wheel can rotate in one direction with the depressible stop member retracting into its housing against spring pressure as the ramp passes beneath it and once the ramp has passed beneath it, the depressible stop member extends out of its chamber and the abutment surface of the boss will prevent the wheel from being rotated in a reverse direction.

The compartments of the chamber are each numbered and there are an equal number of cards having corresponding numbers on them. The cards are placed through the appropriately numbered slots into the compartments and as the wheel is turned, the next numbered card will drop through the opening in the sleeve and into the axial cavity of the sleeve to be picked up by the challenger. The challenger will hold that card and will know his order of placement as a result of the number of the card. The next challenger can rotate the wheel through one notching sequence and the next numbered card will drop through the opening into the axial cavity of the sleeve and the challenger can pick up that card and know his order in the challenge ladder. This process continues until all or most of the cards are dispensed. When it is a challenger's turn to play, he gives his number to the winner and the winner replaces the numbered card in the appropriate numbered slot on the wheel to be dispensed in order as the wheel is turned.

DESCRIPTION OF THE PREFERRED EMBODIMENT

Figure 1:
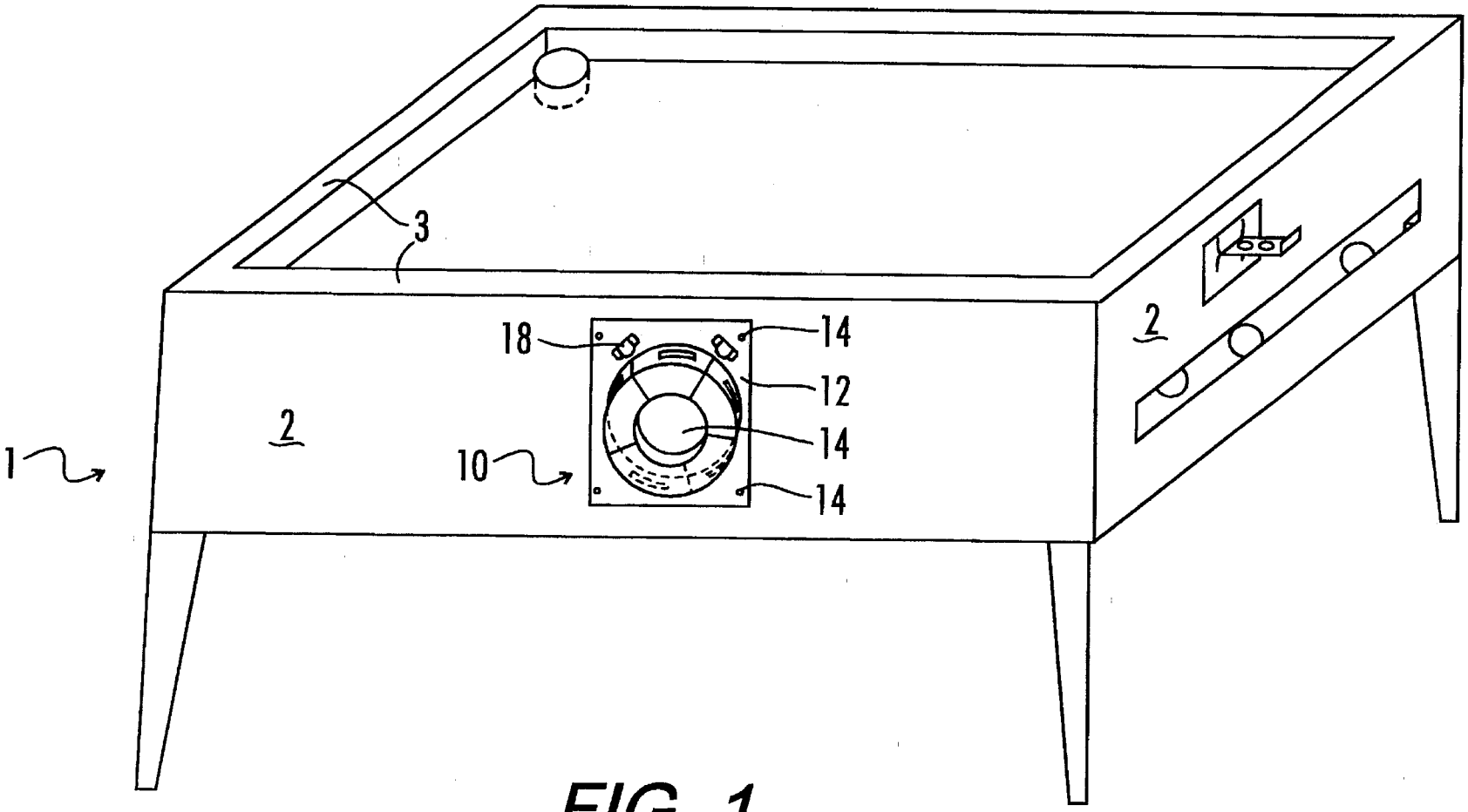
FIG. 1 illustrates schematically in perspective view a pool table with the device of the present invention attached to the side of the pool table.

Applicant's invention will be best understood by reviewing the following description of the preferred embodiment of the invention along with the illustration of the preferred embodiment as shown in FIGS. 1–7 of the attached drawings. Referring to the drawings, FIG. 1 shows schematically, in perspective, a pool table 1 having sides 2 and rails 3 with a coin operated mechanism on one end of the pool table and Applicant's invention mounted on side 2 of the pool table. The preferred embodiment of the device 10 of Applicant's invention is shown generally in FIG. 1 mounted in place on side 2 of the pool table. The general shape of the device 10 is that of an automobile tire mounted to rotate about a hub or axis with slots cut in the circumferential perimeter of the device. FIGS. 2–6 illustrate the preferred embodiment of the invention in greater detail.

Referring to FIGS. 2–6, the device 10 includes a plate 12 which is attached to the pool table 1 by screws 14 passing through passageways 15 in the plate 12. A hole 16 is centrally located within the plate 12. The plate 12 also includes depressible stop members 18 constructed of housing 20 with a movable block 23 fitted within the housing 20. The movable block 23 slides part way out of the housing and can retract into the housing against the pressure of spring 22 which, upon release of the compression force against the spring, will force the block 23 back to its at rest position extending out of the housing 20.

The second element of the device 10 is the ticket dispensing wheel 32. The wheel 32 is generally circular in shape to mate with and fit within the hole 16 in the plate 12 and has an open front 34, a back panel 36 and a circumferential perimeter 38 connected to the outer edges of the back panel of the wheel. A center aperture 42 is provided in the wheel 32 and the aperture 42 is of a size and shape to mate with the outer perimeter of the sleeve 24 as described in detail hereinafter. Thus, the sleeve 24 will fit within the aperture 42 of the wheel 32 which can then rotate about the sleeve 24 much as a wheel would rotate about a hub.

The third element of the preferred embodiment is the cover 25. Cover 25 includes the cylindrically shaped sleeve 24 mounted on disc 27. Disc 27 is donut-shaped to mate with and cover open front 34 of the ticket dispensing wheel 32. Cap 29 covers the end of sleeve 24 opposite the end attached to disc 27, and cover 25 is mounted on the pool table by screws 14 (See FIG. 1) passing through cap 29 so that the sleeve 24 and disc 27 remain stationary throughout the operation of the device.

The assembled elements of the device gives it the shape generally of an automobile tire including a thickness t and a chamber 40 defined by the disc 27, back panel 36 and the outer circumferential perimeter 38 of the wheel. The plate 12 and the cover 25 do not move, but the dispensing wheel 32 rotates about the sleeve 24 to enable operation of the device as is described herein.

The sleeve 24, as indicated, is cylindrical and when mounted to the pool table, has an axis 28 projecting perpendicularly from the side of the pool table. An opening 26 is formed or cut in the top of the sleeve 24 and that opening 26 is in communication with the axial cavity 30 within the sleeve 24.

Figure 2:
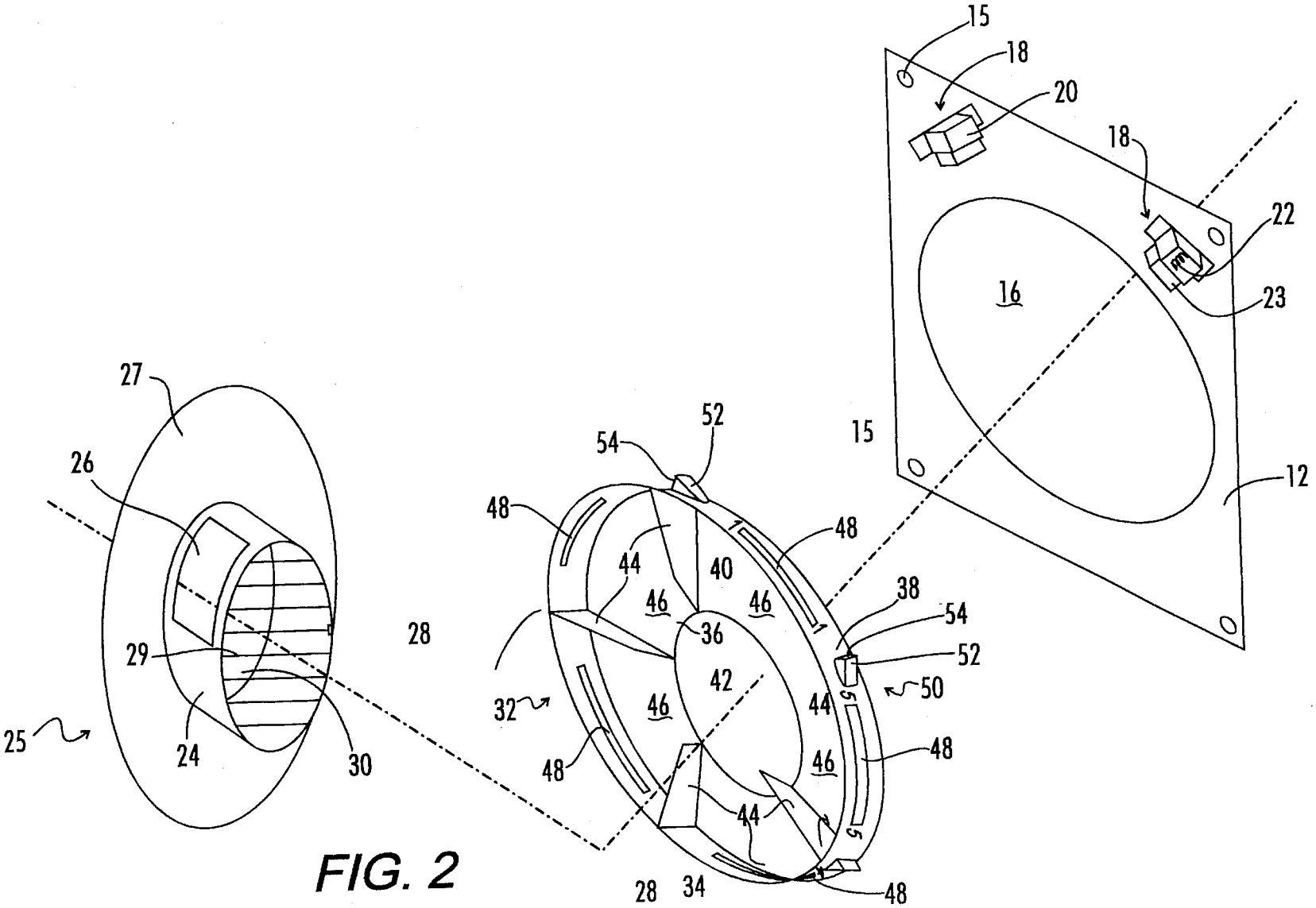
FIG. 2 shows in exploded perspective view the device of the present invention.
Figure 5:
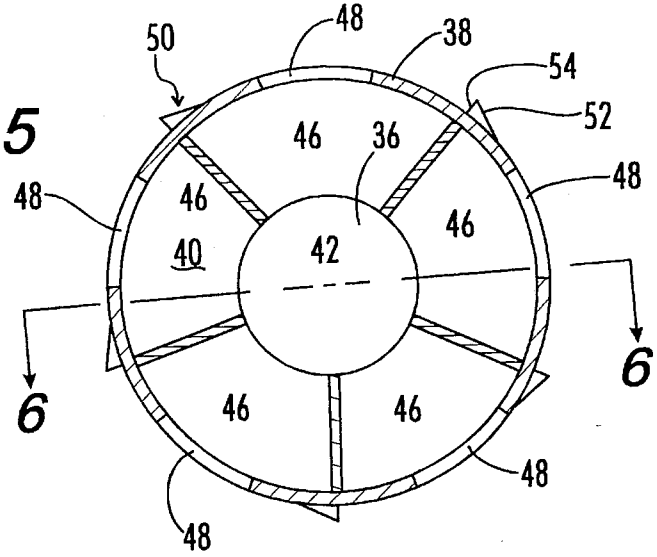
FIG. 5 is a side view in cross section of the wheel of the present invention.
Figure 6:
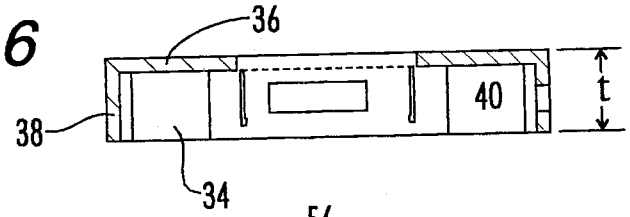
FIG. 6 is a cross section taken along the line 6—6 of FIG. 5.
Figure 7:
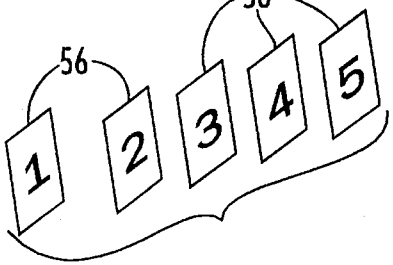
FIG. 7 is a schematic view of the cards used in the present invention.
Figure 4:
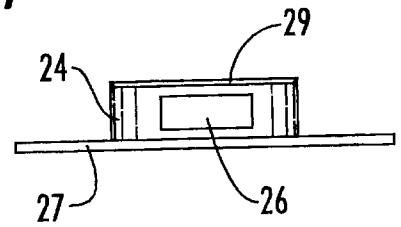
FIG. 4 is a top view of the cover of the invention.
Figure 3:
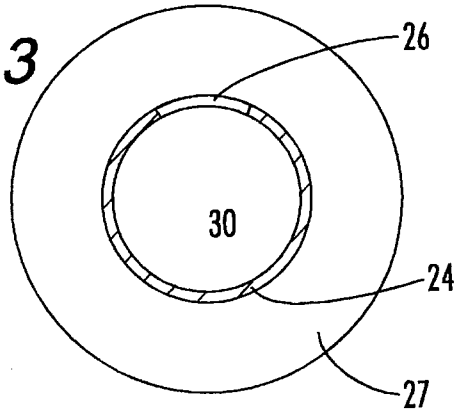
FIG. 3 shows a side view in cross section of the cover of the present invention.

Looking again at FIGS. 2, 5 and 6, the wheel 32 is shown as having vanes 44 dividing the chamber 40 into a number of compartments 46. The preferred embodiment illustrates five vanes 44 dividing the chamber 40 into five compartments 46, but as few as three compartments can be created and the upper limit of compartments is controlled only by practical needs of the device.

On the outer circumference 38 of the wheel 32, there are formed or created slots 48, one numbered slot for each compartment 46 so that a card 56 (see FIG. 7), can be slipped through the slot 48 into the compartment 46.

When the device is assembled, the sleeve 24 will hold a card in a compartment until the wheel 32 is rotated so that the compartment overlies the opening 26 in the sleeve 24. At that time, a card within the compartment will drop through the opening 26 into the axial cavity 30 of the device and a player can reach into the cavity and take the card that will identify his position or turn, in the order of challengers.

In order to make sure that the wheel 38 is turned only in one direction so as to keep the order of play under control, the wheel 38 is provided with ratchet bosses 50. The bosses 50 include a ramp surface 52 and an abutment surface 54. The ramp surfaces of the bosses will slide beneath the blocks 23 and will force the block into the housing 20 against the pressure of spring 22 so that the wheel can turn in a clockwise direction. Once the boss passes beneath the block 23, the spring 22 will force the block 23 out of the housing and the abutting surface 54 will keep the wheel from being turned in a counter-clockwise direction.

The use of the device 10 is implemented as follows: when there are only two players (or two teams), there is no need to employ the device 10. However, when a challenger arrives, the device 10 should be set so that the number "1" on the perimeter 38 of the wheel 32 is in the vertical position overlying the opening 26 on the sleeve 24 and the card 56 bearing the number "1" should be in the axial cavity 30. The challenger will then take the card 56 numbered "1" and hold it until the game in progress is completed. Of course, if no-one else arrives to challenge, the first challenger would simply place the card back in the slot numbered "1" on the wheel 32 and the card would fall through the system into the axial cavity 30 and be available for the next challenger. However, if during the course of play a second challenger arrives, the second challenger would rotate the wheel 32 in a clockwise direction one ratcheted position and the number "2" on the perimeter 38 of wheel 32 would rotate to the vertical position and the card 56 bearing the number "2" that would be within the compartment 46 numbered "2" would drop through the opening 26 into the axial cavity 30 and be taken by the second challenger. As additional challengers arrive, the wheel 32 would be rotated clockwise one notch for each challenger and the challenger would take the card out of the axial cavity 30 as it drops through the opening 26 in the sleeve 24. Thus, each player will have a card identifying the number or order of play that he assumes in the challenge.

When the game in progress is concluded, the challenger holding card number "1" will give it to the winner, pay the money to start the game and the winner will insert the card into the slot numbered "1" where it will stay until the wheel 32 is rotated so that the chamber numbered "1" arrives at the vertical position by succession. When the game involving the first challenger is completed, the next lowest number available would be number "2" and therefore the challenger holding the card numbered "2" would be next up. Since the dispensing of numbers goes "around the horn", if there are five challengers, the challenger playing the current game would simply hold his card until the game was completed so that there would be a gap in the positioning of the cards and the next lowest number following the card held by the challenger completing the game would be next up.

The cards 56 can be made of laminated cardboard stock material encased in a plastic or other material with advertising and related information material on them and are reusable many times over at a facility. However, such cards can be easily replaced as they wear.

Variations of the preferred embodiment of the invention can be accomplished within the scope of the invention as defined by the appended claims. For example, the plate and sleeve could be an integral structure, the ratcheting mechanism could be reversed and similar modifications of the structure of the device would be well within the scope of the invention as is hereinafter claimed. Letters, rather than numbers, could be imprinted on the cards and used as the sequencing control device, etc.

Although there have been described particular embodiments of the present invention of a new and useful order of participation control device, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A device to facilitate control of the order of participation of persons in an activity, said device including:

a. plurality of indicator devices, each indicator device bearing an identifier indicia, each identifier indicia being distinct from every other identifier indicia and the identifier indicia of the plurality of indicator devices being in consecutive order;

b. a dispenser device, said dispenser device including a plurality of compartments, the number of compartments in the dispenser device equaling the number of indicator devices, said compartments marked with identifier indicia, each identifier indicia being next in sequence to the immediately preceding identifier indicia;

c. insertion means whereby one of the plurality of indicator devices can be inserted into a compartment regardless of the position of the dispensing device;

d. dispensing means whereby an indicator device placed within a compartment of said dispensing device can be removed from said dispensing device, but only when said compartment is in a predetermined location; and e. means mounting said dispensing device for movement along a predetermined path whereby said compartments are placed in communication with said dispensing means serially.

2. The device of claim 1 wherein the plurality of indicator devices are cards and the identifier indicia are numbers on the cards.

3. A device to facilitate control of the order of participation of persons in an activity, said device including:

a. a cylindrically shaped sleeve having an axial cavity;

b. a dispensing wheel, said dispensing wheel having a hub of a size and shape to mate with and rotate about the said sleeve, said dispensing wheel including a chamber divided into a number of compartments, said dispensing wheel including an outer perimeter with a number of holes in the outer perimeter, the number of holes equaling the number of compartments and a separate hole communicating with each compartment;

c. said sleeve adapted to be mounted in a fixed position with said dispensing wheel mounted to rotate about said sleeve;

d. a hole in said sleeve whereby a compartment within said dispensing wheel in registry with said hole would allow a card within said compartment to drop through said hole into the axial cavity of said sleeve;

e. a plurality of cards, the number of cards equal to the number of compartments and said cards bearing consecutive identifiers; and f. said compartments bearing the same consecutive identifiers as said cards.

4. The device of claim 3 wherein said sleeve is mounted on a disc and the disc serves as a cover for the dispensing wheel.

5. The device of claim 3 further including means to allow said dispensing wheel to rotate about said sleeve in one direction and to prevent said dispensing wheel from rotating in an opposite direction.

6. The device of claim 3 wherein said cards are consecutively numbered and said compartments are consecutively numbered.

* * * * *